US005330707A

United States Patent [19]

Khare

[11] Patent Number: 5,330,707

[45] Date of Patent: Jul. 19, 1994

[54] STEEL FOR MAKING VERY LARGE PIPE MOLDS

[75] Inventor: Ashok K. Khare, Warren, Pa.

[73] Assignee: National Forge Company, Irvine, Pa.

[21] Appl. No.: 82,986

[22] Filed: Jun. 25, 1993

[51] Int. Cl.[5] ..... C22C 38/46; C22C 38/44

[52] U.S. Cl. ..... 420/109; 148/335

[58] Field of Search ..... 420/109; 148/335

[56] References Cited

FOREIGN PATENT DOCUMENTS 2260539 7/1973 Fed. Rep. of Germany ..... 420/109

51-39521 4/1976 Japan ..... 420/109

*Primary Examiner*—Deborah Yee

*Attorney, Agent, or Firm*—Hale and Dorr

[57] ABSTRACT

A ferritic alloy steel that may be used for making very large pipe molds with high ductility and high toughness for centrifugally casting pipe with an inside diameter that may exceed 40 inches, the steel consisting essentially of from about 0.12% to about 0.18% carbon, about 0.70% to about 0.95% manganese, about 0.008% maximum phosphorous, about 0.008% maximum sulphur, about 0.20% to about 0.35% silicon, about 1.05% to about 1.25% nickel, about 1.85% to about 2.25% chromium, about 0.60% to about 0.75% molybdenum, about 0.03% to about 0.08% vanadium, and balance essentially iron.

4 Claims, No Drawings

STEEL FOR MAKING VERY LARGE PIPE MOLDS

TECHNICAL FIELD

The present invention relates to ferritic alloy steels used for making pipe molds. More particularly, the present invention relates to ferritic alloy steels for making very large pipe molds which may be used for centrifugally casting pipe with an inside diameter greater than 40 inches.

BACKGROUND OF THE INVENTION

Pipe molds that are used for centrifugally casting pipe normally have an elongated cylindrical section with a "Bell" and a "Spigot" end. These ends are separated by a "Barrel" section. One of the most commonly used steels for making pipe molds for centrifugally casting pipe is the AISI 4130 grade. This steel grade according to the "AISI 4130," *Alloy Digest—Data On World Wide Metals And Alloys,* Nov. 1954, Revised Mar. 1988, p. 3 and Katus, J.R., "Ferrous Alloys—4130," *Aerospace Structural Metals Handbook,* 1986 Pub., pp. 1-20 can have the chemistries set forth in Table I:

TABLE I

| Element | Alloy Digest Weight % | Aerospace Handbook Weight % |
|---|---|---|
| Carbon | 0.28–0.33 | 0.28–0.33 |
| Manganese | 0.40–0.60 | 0.40–0.60 |
| Silicon | 0.20–0.35 | 0.20–0.35 |
| Phosphorous | 0.04 Maximum | 0.025 Maximum |
| Sulphur | 0.04 Maximum | 0.025 Maximum |
| Chromium | 0.80–1.10 | 0.80–1.10 |
| Molybdenum | 0.15–0.25 | 0.15–0.25 |
| Nickel | — | 0.25 Maximum |
| Copper | — | 0.35 Maximum |
| Iron | Balance | Balance |

The AISI 4130 grade steel does not contain vanadium, does not have high levels of manganese, at best has low levels of nickel, has only moderate levels of chromium, and has low levels of molybdenum.

Conventional thinking has been that pipe mold service life is primarily dependent on the properties of hardness and strength of the as-heat treated pipe mold. Because of this, the only properties considered were these in attempting to make pipe molds with long service lives.

The main element that imparts hardness and strength to pipe mold steels is carbon. Therefore, it has been thought that to create pipe molds with long service lives there had to be high levels of carbon in the steel. Consistent with this thinking, the AISI 4130 grade had high carbon in the range of 0.28–0.33%.

A departure from this thinking was to make the carbon level directly related to the pipe mold size. Table II is an example of this:

TABLE II

| Pipe Mold Size | Carbon Range | Aim |
|---|---|---|
| 80 mm (3.2 in.) | 0.24–0.29% | 0.26% |
| 100 mm (4 in.) | 0.24–0.30% | 0.27% |
| 150 mm (6 in.) | 0.24–0.30% | 0.27% |
| 200 mm (8 in.) | 0.26–0.31% | 0.28% |
| 250 mm (10 in.) | 0.27–0.32% | 0.29% |
| 350–1200 mm (14–40 in.) | 0.28–0.33% | 0.30% |

The carbon gradient shown in Table II is based on the pipe mold size. Since small size pipe molds with high carbon had a greater likelihood of quench cracking during heat treatment or premature failure during service, the carbon was reduced to the levels shown. Larger size pipe molds overcame this by the mass of the pipe mold which results in a slower cooling rate during the quenching step; therefore, the higher carbon levels could be maintained. Even in light of this small alteration in the carbon range to accommodate pipe mold size, Table II follows conventional thinking and considers only hardness and strength, as evidenced by the generally high carbon levels that are listed for the various pipe mold sizes.

There can be problems in making pipe molds from steel that includes high carbon levels if the carbon is not properly accounted for in the heat treating process. In the austenizing for quench step of the heat treating process, the temperature of the normalized pipe mold is raised from room temperature to the austenizing temperature, then it is water quenched to room temperature. The microstructure of the pipe mold at this stage is such that the pipe mold is very hard and has a great deal of internal stresses. This quenching is followed by a tempering step which tempers hardness, thereby making the pipe mold softer and alleviating many of the internal stresses; yet a great deal of these stresses remain. These remaining internal stresses can result in quench cracking during pipe mold manufacture or cracking due to thermal fatigue, and in distortion during pipe production.

Very large pipe molds are difficult to impart the desired properties during heat treatment. The heat treatment problem discussed above for pipe molds generally is magnified because of the section size and mass of very large pipe molds. There is a need for a steel for making a very large pipe mold with improved service life that overcomes this and other problems.

SUMMARY OF THE INVENTION

The present invention is a steel for making very large pipe molds with improved service lives that may be used for centrifugally casting pipe. These pipe molds are very large section, very large mass pipe molds that are capable of producing pipe with an inside diameter greater than 40 inches.

The primary properties of the steel of the present invention for making very large pipe molds are ductility and toughness rather than strength and hardness. To accomplish this, the steel of the present invention includes vanadium and reduced carbon. The further alloying of the steel of the present invention includes levels of manganese, nickel, chromium, and molybdenum that have the combined effect of permitting the very large section, very large mass pipe molds to have the desired properties for improved service life.

An object of the present invention is to provide a steel for making very large pipe molds with improved service life for centrifugally casting pipe.

Another object of the present invention is to provide a steel for making very large pipe molds for centrifugally casting pipe that has vanadium and a reduced carbon as well as manganese, nickel, chromium, and molybdenum in specified ranges that permit an as-heat treated very large section, very large mass pipe mold to obtain the desired properties of toughness and ductility for improved service life.

These and other objects of the invention will be described in detail in the remainder of the specification.

DETAILED DESCRIPTION OF THE INVENTION

The present invention is a steel for making very large pipe molds with improved service life. These pipe molds may be used for centrifugally casting pipe with an inside diameter greater than 40 inches. The primary properties that contribute to the very large pipe molds having improved service lives are ductility and toughness rather than hardness and strength. The combination of the vanadium and reduced carbon in the ranges specified for the steel of the present invention promotes the desired toughness and ductility. Moreover, the alloying of the steel with manganese, nickel, chromium, and molybdenum in the ranges specified promotes the desired toughness and ductility in the as-heat treated very large section, very large mass pipe molds. The weight percentages of the steel of the present invention for making very large pipe molds, which has been designated "Khare III, " are set forth in Table III:

TABLE III

| Element | Weight % | Aim % |
|---|---|---|
| Carbon | 0.12–0.18% | 0.15% |
| Manganese | 0.70–0.95% | 0.85% |
| Phosphorous | 0.008% Maximum | Low As Possible |
| Sulphur | 0.008% Maximum | Low As Possible |
| Silicon | 0.20–0.35% | 0.25% |
| Nickel | 1.05–1.25% | 1.10% |
| Chromium | 1.85–2.25% | 2.00% |
| Molybdenum | 0.60–0.75% | 0.65% |
| Vanadium | 0.03–0.08% | 0.05% |
| Iron | Balance | Balance |

Before discussing the effects of reduced carbon, vanadium, manganese, nickel, chromium, and molybdenum in the specified ranges in the steel of the present invention, the method for making very large pipe molds from the steel of the present invention will be discussed.

An ingot from which a very large section, very large mass pipe mold is made may be formed by any of a number of methods. These methods include, but are not limited to, casting, hot isostatic pressing, and cold isostatic pressing. The workpiece is produced by mandrel and/or saddle forging the ingot. Following this, the workpiece is heat treated for properties. The heat treating process includes normalizing, austenizing for quench, water quench, and tempering.

The first step, normalizing, is accomplished by heating the workpiece above the $A_3$ temperature and then air cooling it to room temperature. Next the workpiece is austenized for quench. In performing this step, the workpiece is heated above the $A_3$ temperature. The following step is the workpiece is quenched in water until it reaches room temperature. The final step of the method is tempering. According to this step, the workpiece is heated to a temperature below the $A_1$ temperature and then air cooled to room temperature. After this step, the very large pipe mold has the desired properties.

The effects of the alloying elements of the steel of the present invention will be now discussed.

The carbon level of the steel chemistry of the present invention is lower than in the conventional AISI 4130 range of 0.28–0.33% and even lower than the 0.24–0.33% range in Table II. Important here, the reduced carbon results in a reduction in hardness and strength coupled with an increase in toughness and ductility in the as-heat treated very large pipe mold. The reduced carbon also helps reduce the internal stresses of the steel of the present invention. This will mean that there is greater stability after tempering in the very large pipe molds made from the steel of the present invention. As such, the very large pipe molds will be less susceptible to quench cracking during the manufacture or due to thermal fatigue, and distortion during production.

Vanadium in the range of 0.03–0.08% is added to the steel of the present invention to give the steel fine grain size and prevent softening during temper. Vanadium was not included in the AISI 4130 grade of steel. The fine grain size working in conjunction with the low stresses resulting from the use of reduced carbon enhances the stability of the steel of the present invention. Vanadium, along with the alloying elements manganese and molybdenum, help maintain the desired level of post-temper hardness.

Manganese in the 0.70–0.95% range provides a high carbon/manganese ratio. Manganese in this range promotes deep hardening at the desired levels without adversely affecting the desired properties of toughness and ductility.

Nickel in the range of 1.05–1.25% moves the time/-temperature transformation curve to the right. As such, the time window for quenching the workpiece to obtain the desired properties is increased. The time window that is increased is time from when the workpiece leaves the furnace in the austenizing for quench step until the workpiece actually is subjected to the water quench.

The range of the chromium from 1.85–2.25% represents high chromium. This gives the as-heat treated very large pipe molds high temperature properties. More specifically, the high chromium has the effect of avoiding softening of the very large pipe molds when they are exposed to elevated temperatures in service. This is realized by the fact that in service the very large pipe molds will produce very large section, very large mass pipe, the production of which will cause a higher heat content to remain in the pipe mold for longer periods of time. The strength that is provided by the high chromium level does not adversely affect the desired properties of toughness and ductility.

The high level of molybdenum in the range of 0.60–0.75% is the most potent hardenability agent for the steel of the present invention. Of particular interest here, molybdenum in the specified range provides deep hardening in light of the slower cooling rates of the very large pipe molds. This molybdenum range will help the as-heat treated very large pipe molds resist cracking in service.

The terms and expressions that are used herein are terms of expression and not of limitation. And there is no intention in the use of such terms and expressions of excluding the equivalents of the features shown and described, or portions thereon, it being recognized that various modifications are possible in the scope of the present invention.

I claim:

1. A ferritic alloy steel generally used for high temperature applications in weight percentage consisting essentially of from about 0.12% to about 0.18% carbon, about 0.70% to about 0.95% manganese, about 0.008% maximum phosphorous, about 0.008% sulphur, about 0.20% to about 0.35% silicon, about 1.05% to about 1.25% nickel, about 1.85% to about 2.25% chromium, about 0.60% to about 0.75% molybdenum, about 0.03% to about 0.08% vanadium, and balance essentially iron.

2. The steel as recited in claim 1, consisting essentially of about 0.15% carbon, about 0.85% manganese, about 0.008% maximum phosphorous, about 0.008% maximum sulphur, about 0.25% silicon, about 1.10% nickel, about 2.00% chromium, about 0.65% molybdenum, about 0.05% vanadium, and balance essentially iron.

3. A pipe mold for centrifugally casting pipe formed from a ferritic alloy steel in weight percentage consisting essentially of from about 0.12% to about 0.18% carbon, about 0.70% to about 0.95% manganese, about 0.008% maximum phosphorous, about 0.008% maximum sulphur, about 0.20% to about 0.35% silicon, about 1.05% to about 1.25% nickel, about 1.85% to about 2.25% chromium, about 0.60% to about 0.75% molybdenum, about 0.03% to about 0.08% vanadium, and balance essentially iron.

4. The pipe mold as recited in claim 3, consisting essentially of about 0.15% carbon, about 0.85% manganese, about 0.008% maximum phosphorous, about 0.008% maximum sulphur, about 0.25% silicon, about 1.10% nickel, about 2.00% chromium, about 0.65% molybdenum, about 0.05% vanadium, and balance essentially iron.

* * * * *